US006318324B1

(12) United States Patent
Koeroghlian et al.

(10) Patent No.: US 6,318,324 B1
(45) Date of Patent: Nov. 20, 2001

(54) SEALED HYDRAULIC LIFTER FOR EXTREME ANGLE OPERATION

(75) Inventors: Mark Koeroghlian, Williamston; Alan Falkowski, Lake Orion, both of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/208,600

(22) Filed: Dec. 7, 1998

(51) Int. Cl.[7] ..... F01L 1/24; F01L 1/14

(52) U.S. Cl. ..... 123/90.55; 123/90.35; 123/90.37; 123/90.55; 123/90.61; 123/90.63

(58) Field of Search ..... 123/90.35, 90.37, 123/90.48, 90.49, 90.52, 90.55, 90.57, 90.61

(56) References Cited

U.S. PATENT DOCUMENTS

| | | | | |
|---|---|---|---|---|
| Re. 35,282 | * | 6/1996 | Blane | 123/90.61 |
| 2,386,317 | | 10/1945 | Jenny et al. . | |
| 2,956,557 | * | 10/1960 | Dadd | 123/90.55 |
| 2,966,151 | | 12/1960 | Wood . | |
| 3,014,472 | | 12/1961 | Wisman . | |
| 3,262,434 | * | 7/1966 | Kuchen et al. | 123/90.19 |
| 3,304,925 | | 2/1967 | Rhoads . | |
| 3,967,602 | | 7/1976 | Brown . | |
| 4,361,120 | | 11/1982 | Kueny . | |
| 4,436,063 | * | 3/1984 | Usui | 123/90.61 |
| 4,524,731 | | 6/1985 | Rhoads . | |
| 4,535,734 | * | 8/1985 | Kodama et al. | 123/90.58 |
| 4,644,913 | | 2/1987 | Stoody, Jr. . | |
| 4,708,102 | | 11/1987 | Schmid . | |
| 4,807,575 | | 2/1989 | Litwinchuk et al. . | |
| 4,881,499 | * | 11/1989 | Dietrich et al. | 123/90.52 |
| 4,977,867 | * | 12/1990 | Rhoads | 123/90.49 |
| 5,027,763 | * | 7/1991 | Mallas | 123/90.61 |
| 5,357,916 | | 10/1994 | Matterazzo . | |
| 5,562,072 | | 10/1996 | Stoody, Jr. . | |
| 5,622,147 | | 4/1997 | Edelmayer . | |

* cited by examiner

*Primary Examiner*—Weilun Lo
(74) *Attorney, Agent, or Firm*—Roland A. Fuller, III

(57) ABSTRACT

A hydraulic lash adjuster for an engine is provided that includes a resilient seal received over a plunger assembly above a fluid return aperture in the plunger body. The hollow interior of the pushrod which supplies the hydraulic lash adjuster with fluid provides a secondary low pressure fluid cavity which allows the overall length of the hydraulic lash adjuster to be shortened, thus removing mass from the valve train and improving the valve train dynamics. This configuration prevents fluid from escaping the lash adjuster, allowing the lash adjuster to be positioned in the engine over a wider range of operating angles. Supplying fluid from the pushrod also eliminates the need to machine a fluid supply bore into the body of the hydraulic lash adjuster as well as the need to orient the fluid supply bore to a fluid gallery in the engine block.

5 Claims, 1 Drawing Sheet

SEALED HYDRAULIC LIFTER FOR EXTREME ANGLE OPERATION

BACKGROUND OF THE INVENTION

1. Technical Field

The present invention relates generally to hydraulic lash adjusters and more particularly to a hydraulic lash adjuster which may be integrated into an engine over a wider range of operation angles.

2. Discussion

Hydraulic lash adjusters for automotive engines have been in use for many years, allowing engine manufacturers to eliminate lash between valve train components under varying operating conditions to maintain efficiency and to reduce noise in the valve train. Hydraulic lash adjusters operate on the principle of transmitting the energy of the valve actuating cam lobe through hydraulic fluid trapped in a pressure chamber underneath a plunger. As the length of the valve actuation components vary due to temperature changes, small quantities of hydraulic fluid are permitted to enter or escape from the pressure chamber during each operation of the cam lobe and thus effect an adjustment in the position of the plunger and consequently an adjustment in the lash of the valve train.

The cam lobe operating cycle comprises two distinct events: base circle and valve actuation. The base circle event is characterized by a constant radius between the center of rotation of the cam lobe and the cam follower during which effectively no cam energy is transmitted. The valve actuation event is characterized by a varying radius between the cam lobe center of rotation and the cam follower which effectively transmits cam energy to open an engine valve. During the valve actuation event, a portion of the load created by the valve spring, the inertia of valve train components and cylinder pressure is transmitted through the valve train including the lash adjuster, thus raising the pressure of the hydraulic fluid within the lash adjuster pressure chamber in proportion to the plunger area. As most modern hydraulic lash adjusters do not incorporate a seal between the adjuster body and plunger, the high pressure created by the load causes an amount of fluid to escape between the plunger and the inner wall of the lash adjuster body. As the fluid escapes from the pressure chamber, the plunger moves down in proportion to the amount of fluid which has escaped, causing the effective length of the lash adjuster to shorten. During the base circle event, the lash adjuster plunger spring moves the plunger up and eliminates the clearance between the valve actuation components. This in turn creates a pressure differential which causes hydraulic fluid to be drawn into the pressure chamber through the plunger check valve.

In modem hydraulic lash adjusters the escape of fluid from the pressure chamber is controlled by the clearance between the inner wall of the lash adjuster body and the plunger. As effective operation of the lash adjuster requires precise control of the amount of fluid escaping from the pressure chamber, the fit between the body and the plunger must be controlled very closely. To ensure the proper fit, it is typically necessary to selectively fit these components together. While this design has been received with commercial acceptance, several limitations are apparent.

One primary limitation concerns the applications in which these designs may be utilized. As these hydraulic lash adjusters are designed to leak, they must be incorporated into the engine within a relatively narrow range of operating angles to prevent fluid from draining out of the lash adjuster body and into the engine cavity when the engine is not operating and lost fluid is not being replenished. If this narrow range of installation angles is exceeded, fluid will drain out of the lash adjuster body into the engine cavity until the engine is operated and the fluid can be replenished. If the fluid in the lash adjuster drains to a very low level, the lash adjuster will not be able to eliminate all of the clearance in the valve train when the engine is subsequently started. This will cause air to be injected into the lash adjuster and significantly reduce its ability to remove the lash in the valve train due to the compressibility of the air. Consequently, the engine operator will notice a considerable level of noise caused by the excess clearance in the valve train. Therefore, there remains a need in the art for a hydraulic lash adjuster which can be utilized in a wider range of operating angles.

SUMMARY OF THE INVENTION

It is therefore one object of the present invention to provide a hydraulic lash adjuster which can be utilized in a wider range of operating angles.

It is another object of the present invention to provide a hydraulic lash adjuster which utilizes a resilient seal which is positioned between the adjuster body and the plunger above a fluid return aperture in the plunger.

It is a further object of the present invention to provide a hydraulic lash adjuster which provides improved valve train dynamics.

It is yet another object of the present invention to provide a hydraulic lash adjuster which eliminates the need for drilling an oil feed hole into the adjuster body.

It is still another object of the present invention to provide a hydraulic lash adjuster which eliminates the need to orient an oil feed hole in the hydraulic lash adjuster to the engine block.

In accordance with a preferred embodiment of the present invention, a hydraulic lash adjuster for an engine is provided that includes a resilient seal received over a plunger assembly above a fluid return aperture in the plunger body. Fluid is supplied to the hydraulic lash adjuster through a tubular pushrod. The hollow interior of the pushrod provides a secondary low pressure fluid cavity which allows the overall length of the hydraulic lash adjuster to be shortened, thus removing mass from the valve train and improving the valve train dynamics. This configuration prevents fluid from escaping the lash adjuster, allowing the lash adjuster to be positioned in the engine over a wider range of operating angles. Supplying fluid from the pushrod also eliminates the need to machine a fluid supply hole into the body of the hydraulic lash adjuster as well as the need to orient the fluid supply hole to a fluid gallery.

Additional advantages and features of the present invention will become apparent from the subsequent description and the appended claims, taken in conjunction with the accompanying drawings.

DETAILED DESCRIPTION OF THE PREFERRED EMBODIMENT

Figure 1:
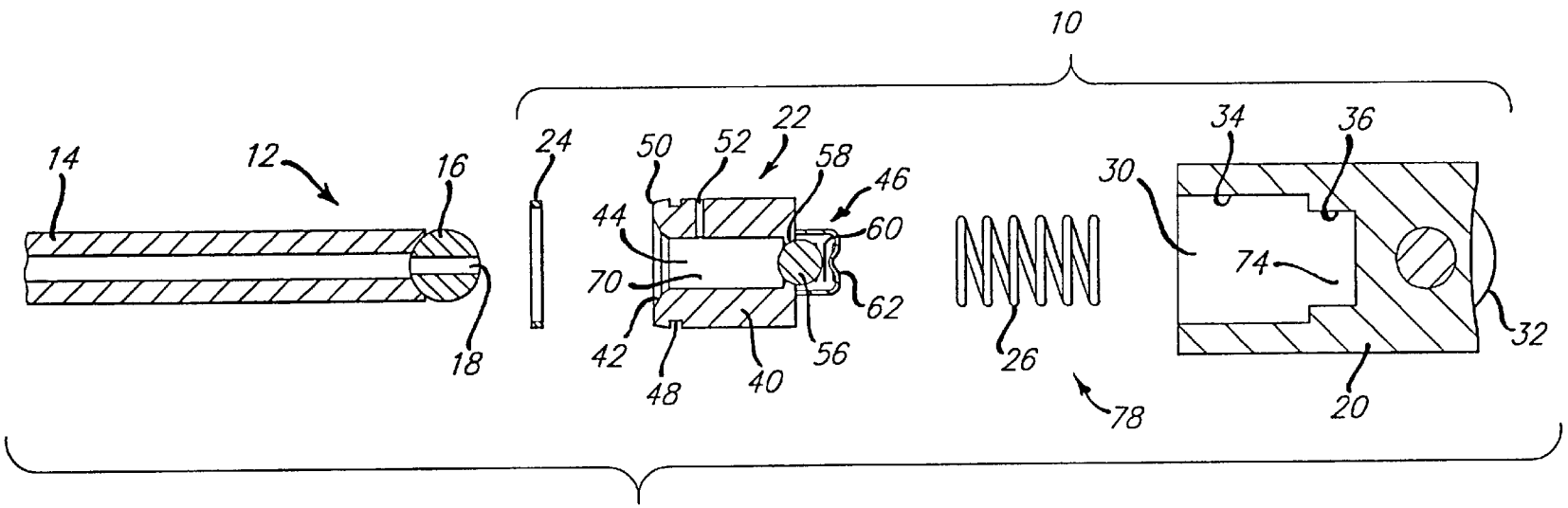
FIG. 1 is an exploded view of a portion of a valve train incorporating the hydraulic lash adjuster of the present invention.
Figure 2:
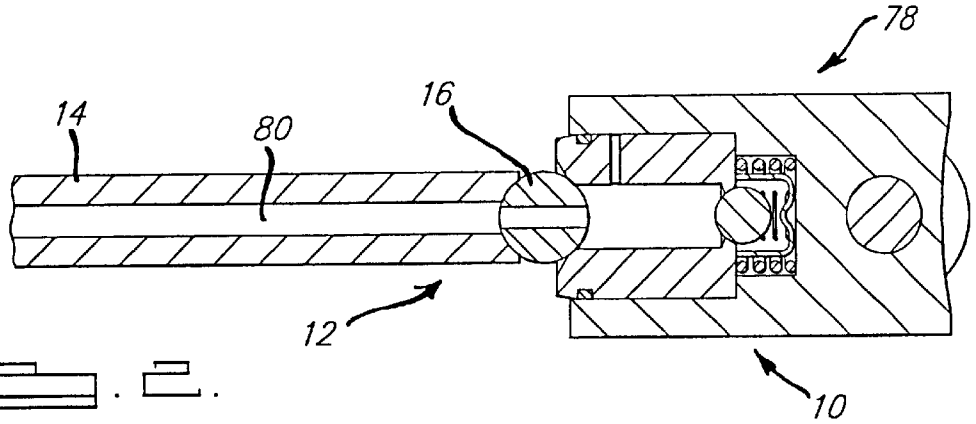
FIG. 2 is a sectional view of a portion of a valve train incorporating the hydraulic lash adjuster of the present invention.

Referring to the drawings wherein like reference numerals designate corresponding parts though out the Figures, the hydraulic lash adjuster of the present invention is indicated generally by reference numeral 10 and is shown in FIG. 1 to be operatively associated with a pushrod 12. Pushrod 12 includes a tubular body portion 14 and a pair of spherical ball ends 16 which are coupled to each end of body portion 14. As shown in FIGS. 1 and 2, ball end 16 is formed by rolling the end of body portion 14. However, ball ends 16 may alternatively be fabricated as separate details and fixedly secured to body portion 14 through an appropriate process, such as welding. Ball ends 16 include an aperture 18 which allows fluid to be dispensed from a rocker arm (not shown) through pushrod 12.

Hydraulic lash adjuster 10 includes an adjuster body 20, a plunger assembly 22, a resilient seal 24 and a spring 26. Adjuster body 20 is generally cylindrical in shape and has a blind bore 30 in one end and a roller 32 at a distal end which is coupled to the adjuster body in a conventional manner. Alternatively, roller 32 could be omitted and a flat tappet (not shown) could be substituted therefore. Blind bore 30 includes a first portion 34 having a first diameter and a second portion 36 having a smaller, second diameter.

Plunger assembly 22 includes a hollow, generally cylindrical plunger body 40, a spherically shaped pushrod seat 42, a fluid entry aperture 44, a check valve assembly 46, a seal groove 48, a tapered edge 50 and a fluid return aperture 52. Pushrod seat 42 is formed in a first end of plunger body 40 and is configured to receive ball end 16. Fluid entry aperture 44 intersects pushrod seat 42, thereby allowing fluid to flow from pushrod 12 into plunger assembly 22.

Check valve assembly 46 includes a ball 56, a seat 58, a spring 60 and a retainer 62. Seat 58 is formed in a distal end of plunger body 40 and is defined by the surface formed at the intersection of fluid entry aperture 44 and the bottom of plunger body 40. Retainer 62 couples spring 60 and ball 56 to plunger body 40. The force exerted by spring 60 pushes ball 56 into seat 58, thereby biasing check valve assembly 46 in a normally closed position.

Resilient seal 24 is received over plunger body 40 and positioned in seal groove 48. Tapered edge 50 is provided to facilitate the installation of seal 24 to plunger body 40 and thereby reduce the risk of damaging seal 24 during its installation. Fluid return aperture 52 is positioned below seal groove 48 and extends through plunger body 40 into fluid entry aperture 44.

Plunger assembly 22 is received in blind bore 30 such that plunger assembly 22 and adjuster body 20 are in sliding engagement. Spring 26 is disposed in blind bore 30 between plunger assembly 22 and adjuster body 20 and urges plunger assembly 22 outward. As is known in the art, a retaining means, such as a retaining ring (not shown), is required to prevent spring 26 from forcing plunger assembly 22 completely out of adjuster body 20.

A low pressure cavity 70 is formed by fluid entry aperture 44, ball end 16 and ball 56. A high pressure cavity 74 is formed between the bottom of plunger assembly 22, blind bore 30 and ball 56. As plunger assembly 22 is in sliding engagement with adjuster body 20, the overall height of hydraulic lash adjuster 10 varies in proportion to the volume of fluid in high pressure cavity 74.

Fluid is supplied to low pressure cavity 70 from pushrod 12. When the pressure of the fluid in low pressure cavity 70 exerts a force on ball 56 which exceeds the force created by spring 60 and the fluid in high pressure cavity 74, the fluid in low pressure cavity 70 will cause ball 56 to move away from seat 58 and thereby permit fluid communication between the low and high pressure cavities 70 and 74. This condition occurs, for example, during a base circle event if the overall height of hydraulic lash adjuster 10 is insufficient to remove all of the lash from the valve train 78. Under these conditions, spring 26 will urge plunger assembly 22 out of blind bore 30 during the base circle event, causing the pressure in high pressure cavity 74 to decline. As a result of the reduced pressure in high pressure cavity 74, the force created by the fluid in low pressure cavity 70 is sufficient to move ball 56 away from seat 58, allowing additional fluid to enter and fill high pressure cavity 74, thereby increasing the overall length of hydraulic lash adjuster 10 and removing lash from valve train 78.

The operational clearance between plunger assembly 22 and adjuster body 20 is typical of conventional hydraulic lash adjusters. This clearance permits fluid in high pressure cavity 74 to escape at a predetermined flow rate. Escaping fluid is returned to low pressure cavity 70 through fluid return aperture 52. Resilient seal 24 prevents fluid from exiting hydraulic lash adjuster 10 and into an engine cavity (not shown). This configuration allows hydraulic lash adjuster 10 to compensate for "negative lash" caused, for example, by thermal expansion of components in valve train 78.

The incorporation of the resilient seal into hydraulic lash adjuster 10 causes the fluid which escapes from high pressure cavity 74 to return to low pressure cavity 70 regardless of the operating angle. As such, hydraulic lash adjuster 10 permits increased flexibility in the design of an engine, providing almost a 180° window in which it may be incorporated into an engine.

Another significant benefit of the hydraulic lash adjuster 10 of the present invention is the ability to improve the dynamic performance of valve train 78. As the components in valve train 78 are subjected to a high speed reciprocating motion, the inertia of valve train 78 is critical. Components having a large mass can effectively reduce the 'safe' operating speed range of the engine. As the hollow interior 80 of pushrod 12 serves as a secondary low pressure fluid cavity, the overall length of hydraulic lash adjuster 10 can be shortened, thereby reducing the overall mass of valve train 78. This allows the valves to be operated with increased speed and increases the range of speeds over which the engine may be operated.

A further benefit of the hydraulic lash adjuster 10 of the present invention is the ability to simplify the process of integrating a lash adjuster into an engine. Typical prior art lash adjusters were supplied with fluid through the body of the lash adjuster and as such, it was necessary to orient the fluid feed hole to a fluid supply gallery in the engine as well as to drill a fluid feed hole through the body. Since fluid is supplied to hydraulic lash adjuster 10 through pushrod 12, the difficulties in orienting the fluid supply and in machining a fluid feed hole through the body of the lash adjuster are avoided.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A hydraulic lash adjuster for an engine comprising:

a body with a blind bore formed therein;

a unitarily formed plunger body slidingly received within said blind bore and having a fluid entry aperture in the top of said plunger body and a fluid return aperture in the side of said plunger body, the fluid entry aperture having a spherically shaped pushrod seat adapted to receive a spherical ball end of a pushrod;

a high pressure cavity formed between the bottom of said blind bore and said plunger body;

a valve opening in said plunger body providing fluid communication between said high pressure cavity and a supply of fluid;

a check valve element for selectively opening or closing said valve opening in response to a pressure differential between said high pressure cavity and said supply of fluid;

a low pressure cavity formed between said check valve element, said fluid entry aperture;

a spring normally urging said plunger body outward of said blind bore; and a seal received over said plunger body and positioned above said fluid return aperture, said seal operable to prevent fluid from flowing from said high pressure cavity into an engine cavity.

2. The hydraulic lash adjuster of claim 1 wherein said fluid return aperture is operable for directing fluid escaping from said high pressure cavity into said low pressure cavity.

3. The hydraulic lash adjuster of claim 1 wherein said plunger body includes a tapered edge which facilitates installation of said seal.

4. A valve train for an engine comprising:

a pushrod having a tubular body portion and a spherically shaped ball end having a fluid dispensing aperture, said ball end coupled to a first end of said body portion, said pushrod operable for supplying a flow of fluid; and a hydraulic lash adjuster having a body with a blind bore formed therein; a unitarily formed plunger body slidingly received within said blind bore and having a spherical pushrod seat, a fluid entry aperture and a fluid return aperture, said ball end being operably coupled to said pushrod seat and permitting fluid communication between said pushrod and said hydraulic lash adjuster; a high pressure cavity formed between the bottom of said blind bore and said plunger body; a valve opening in said plunger body providing fluid communication between said high pressure cavity and a low pressure cavity; a check valve element for selectively opening or closing said valve opening in response to a pressure differential between said high pressure cavity and said low pressure cavity; said low pressure cavity formed between said check valve element and said fluid entry aperture; a spring normally urging said plunger body outward of said blind bore; and a seal disposed between said blind bore and said plunger body and positioned above said fluid return aperture, said seal operable to prevent a flow of fluid from said high pressure cavity to an engine cavity.

5. The valve train for an engine of claim 4 wherein said ball end is secured to said tubular body portion by welding.

* * * * *